US010038271B2

(12) United States Patent
Sakaguchi et al.

(10) Patent No.: US 10,038,271 B2
(45) Date of Patent: Jul. 31, 2018

(54) ELECTRICAL CONNECTOR WITH REDUCED SIZE IN A DIRECTION PERPENDICULAR TO THE ARRANGEMENT AND EXTENDING DIRECTIONS OF TWO WIRES

(71) Applicants: AutoNetworks Technologies, Ltd., Yokkaichi, Mie (JP); Sumitomo Wiring Systems, Ltd., Yokkaichi, Mie (JP); SUMITOMO ELECTRIC INDUSTRIES, LTD., Osaka-shi, Osaka (JP)

(72) Inventors: Kiyokazu Sakaguchi, Mie (JP); Kensaku Takata, Mie (JP)

(73) Assignees: AutoNetworks Technologies, Ltd. (JP); Sumitomo Wiring Systems, Ltd. (JP); Sumitomo Electric Industries, Ltd. (JP)

( * ) Notice: Subject to any disclaimer, the term of this patent is extended or adjusted under 35 U.S.C. 154(b) by 0 days.

(21) Appl. No.: 15/559,943

(22) PCT Filed: Mar. 18, 2016

(86) PCT No.: PCT/JP2016/058669
§ 371 (c)(1),
(2) Date: Sep. 20, 2017

(87) PCT Pub. No.: WO2016/158488
PCT Pub. Date: Oct. 6, 2016

(65) Prior Publication Data

US 2018/0069341 A1 Mar. 8, 2018

(30) Foreign Application Priority Data

Mar. 31, 2015 (JP) ..... 2015-071133

(51) Int. Cl.
*H01R 4/30* (2006.01)
*H01R 13/512* (2006.01)
(Continued)

(52) U.S. Cl.
CPC ..... *H01R 13/512* (2013.01); *H01R 13/521* (2013.01); *H01R 13/5202* (2013.01);
(Continued)

(58) Field of Classification Search
CPC ..... H01R 4/30; H01R 4/302; H01R 11/12; H01R 12/75; H01R 13/567;
(Continued)

(56) References Cited

U.S. PATENT DOCUMENTS

2014/0051286 A1* 2/2014 Itsuki ..... H01R 13/533 439/587

FOREIGN PATENT DOCUMENTS

| | | |
|---|---|---|
| JP | 2010-282924 | 12/2010 |
| JP | 2014-38793 | 2/2014 |
| JP | 2015-82405 | 4/2015 |

OTHER PUBLICATIONS

International Search Report dated Jun. 7, 2016.

* cited by examiner

*Primary Examiner* — Abdullah Riyami
*Assistant Examiner* — Justin Kratt
(74) *Attorney, Agent, or Firm* — Gerald E. Hespos; Michael J. Porco; Matthew T. Hespos

(57) ABSTRACT

A connector includes a housing 10 to be connected to a mating connector, and two conductive unit. Each conductive unit includes a terminal, a wire 43, and an inner conductive member 40 for electrically connecting the terminal and the wire 43. A fixing portion 17 to which the inner conductive members 40 are to be fixed is provided inside the housing
(Continued)

10, one of the inner conductive members 40 is fixed on one side in an arrangement direction of two wires 43 in the housing 10 and the other inner conductive member 40 is fixed on the other side. Each of the two inner conductive members 40 is fixed to the fixing portion 17 by a bolt 22, 23 extending in the arrangement direction.

4 Claims, 6 Drawing Sheets

(51) Int. Cl.

| | |
|---|---|
| ***H01R 13/52*** | (2006.01) |
| *H01R 4/02* | (2006.01) |
| *H01R 43/02* | (2006.01) |
| *H01R 13/6581* | (2011.01) |
| *H01R 13/6593* | (2011.01) |
| *H01R 103/00* | (2006.01) |
| *H01R 24/28* | (2011.01) |
| *H01R 13/504* | (2006.01) |
| *H01R 43/24* | (2006.01) |
| *H01R 12/75* | (2011.01) |
| *H01R 13/56* | (2006.01) |
| *H01R 11/12* | (2006.01) |
| *H01R 13/502* | (2006.01) |
| *H01R 13/58* | (2006.01) |

(52) U.S. Cl.

CPC ..... *H01R 13/5208* (2013.01); *H01R 4/021* (2013.01); *H01R 4/30* (2013.01); *H01R 4/302* (2013.01); *H01R 11/12* (2013.01); *H01R 12/75* (2013.01); *H01R 13/502* (2013.01); *H01R 13/504* (2013.01); *H01R 13/567* (2013.01); *H01R 13/5841* (2013.01); *H01R 13/6581* (2013.01); *H01R 13/6593* (2013.01); *H01R 24/28* (2013.01); *H01R 43/0263* (2013.01); *H01R 43/24* (2013.01); *H01R 2103/00* (2013.01)

(58) Field of Classification Search

CPC .. H01R 13/5841; H01R 24/28; H01R 13/502; H01R 13/504; H01R 43/24

USPC ..... 439/801, 883, 468, 473, 694, 686, 797, 439/881, 466

See application file for complete search history.

ELECTRICAL CONNECTOR WITH REDUCED SIZE IN A DIRECTION PERPENDICULAR TO THE ARRANGEMENT AND EXTENDING DIRECTIONS OF TWO WIRES

BACKGROUND

Field of the Invention

The invention relates to a connector in which two wires are held substantially in parallel in a housing and pulled to the outside.

Description of the Related Art

Japanese Unexamined Patent Publication No. 2014-38793 discloses a connector in which two wires are held substantially in parallel in a housing and are pulled out to outside. The connector described in Japanese Unexamined Patent Publication No. 2014-38793 includes two inner conductive members for connecting terminals and external wires, and two wires connected to the respective inner conductive members are held substantially in parallel in a housing and pulled out to outside. The connector described in Japanese Unexamined Patent Publication No. 2014-38793 also has a terminal fixing portion arranged on one side in a direction perpendicular to both an arrangement direction of the two external wires and an extending direction of those two external wires with respect to the inner conductive members. Each inner conductive member is provided with a through hole through which a bolt is to be inserted in this perpendicular direction, and is fixed to the terminal fixing portion by the bolt extending in the perpendicular direction The connector described in Japanese Unexamined Patent Publication No. 2014-38793 further is configured so that the two inner conductive members are spaced from each other and fixed. Thus, an insulation space is secured between the two inner conductive members, and a partition wall is provided in that insulation space for partitioning between the two inner conductive members.

The bolts are fastened to the terminal fixing portion described in Japanese Unexamined Patent Publication No. 2014-38793, and therefore the terminal fixing portion has a certain width in the above-described perpendicular direction. Thus, according to the connector described in Japanese Unexamined Patent Publication No. 2014-38793, there is a problem that the connector is enlarged in the perpendicular direction.

An object of this specification is to reduce the size of a connector in a direction perpendicular to both an arrangement direction of two wires in a housing and an extending direction of those two wires.

SUMMARY

This specification relates to a connector in which two wires are held substantially in parallel in a housing and are pulled out to outside. The connector includes the housing to be connected to a mating connector and two conductive units. Each conductive unit includes a terminal configured to contact a mating terminal in the mating connector, the wire, and an inner conductive member for electrically connecting the terminal and the wire. A fixing portion to which the inner conductive members are to be fixed is provided inside the housing. One of the inner conductive members is fixed on one side in an arrangement direction of the two wires in the housing and the other inner conductive member is fixed on the other side Each of the inner conductive members is fixed to the fixing portion by a bolt extending in the arrangement direction.

According to the above-described connector, the fixing portion is arranged between the two inner conductive members. Thus, the connector can be reduced in size in the perpendicular direction, as compared to the known connector where the fixing portion is arranged on one side in a direction perpendicular to both the arrangement direction of the two wires and an extending direction of those two wires with respect to the inner conductive members. Specifically, the connector of this invention can be reduced in size in the perpendicular direction by arranging the fixing portion in an insulation space secured to insulate the two inner conductive members.

Further, fixed positions of the two inner conductive members may be located on an extension of the wires when viewed in the arrangement direction. Thus, the above-described connector can be reduced in size in the perpendicular direction, as compared to the case where the fixed position of one inner conductive member and that of the other inner conductive member are shifted in the perpendicular direction or the positions of the wires are shifted in the perpendicular direction with respect to the fixed positions of the two inner conductive members.

A nut to which a bolt for fixing the one inner conductive member to the fixing portion is to be fastened and a nut to which a bolt for fixing the other inner conductive member to the fixing portion is to be fastened may be arranged side by side in the fixing portion in the extending direction of the wires in the housing. According to this configuration, the two nuts are arranged side by side in the extending direction of the two wires and overlap in the arrangement direction. In this way, a width of the fixing portion in the arrangement direction can be narrowed as compared to the case where those nuts do not overlap at all in the arrangement direction.

Further, if the inner conductive member is provided with a through hole through which a bolt is to be inserted in a direction perpendicular to the arrangement direction of the two wires as before, a width of the inner conductive member in the arrangement direction cannot be made smaller than a diameter of the through hole. Thus, the connector is enlarged in the arrangement direction. In contrast, according to the above-described connector, the inner conductive member need not include a through hole through which a bolt is to be inserted in the perpendicular direction. Therefore, the width of the inner conductive member in the arrangement direction can be made narrower than before. More particularly, both the fixing portion and the inner conductive members can be narrowed in the arrangement direction of the two wires so that the housing can be reduced in size in the arrangement direction.

The connector disclosed in this specification includes a housing to be connected to a mating connector, and two conductive units. Each conductive unit includes a terminal configured to contact a mating terminal provided in the mating connector, a wire, and an inner conductive member for electrically connecting the terminal and the wire. A fixing portion is provided inside the housing and the inner conductive members are to be fixed the fixing portion. Two nuts are arranged in parallel in the fixing portion in such a posture that axes extend in a direction perpendicular to a connecting direction of the housing. A bolt for fixing one of the inner conductive members is fastened to one of the nuts from one side in the perpendicular direction and a bolt for fixing the other inner conductive member is fastened to the other nut from the other side in the perpendicular direction. According to the above-described connector, the two nuts are arranged in parallel in such a posture that the axes extend in the direction perpendicular to the connecting direction of the housing, i.e. the two nuts overlaps in the perpendicular direction. Thus, the connector can be reduced in size in the perpendicular direction.

According to the connector disclosed in this specification, it is possible to reduce the size of a connector in a direction perpendicular to both an arrangement direction of two wires in a housing and an extending direction of those two wires.

DETAILED DESCRIPTION

Figure 1:
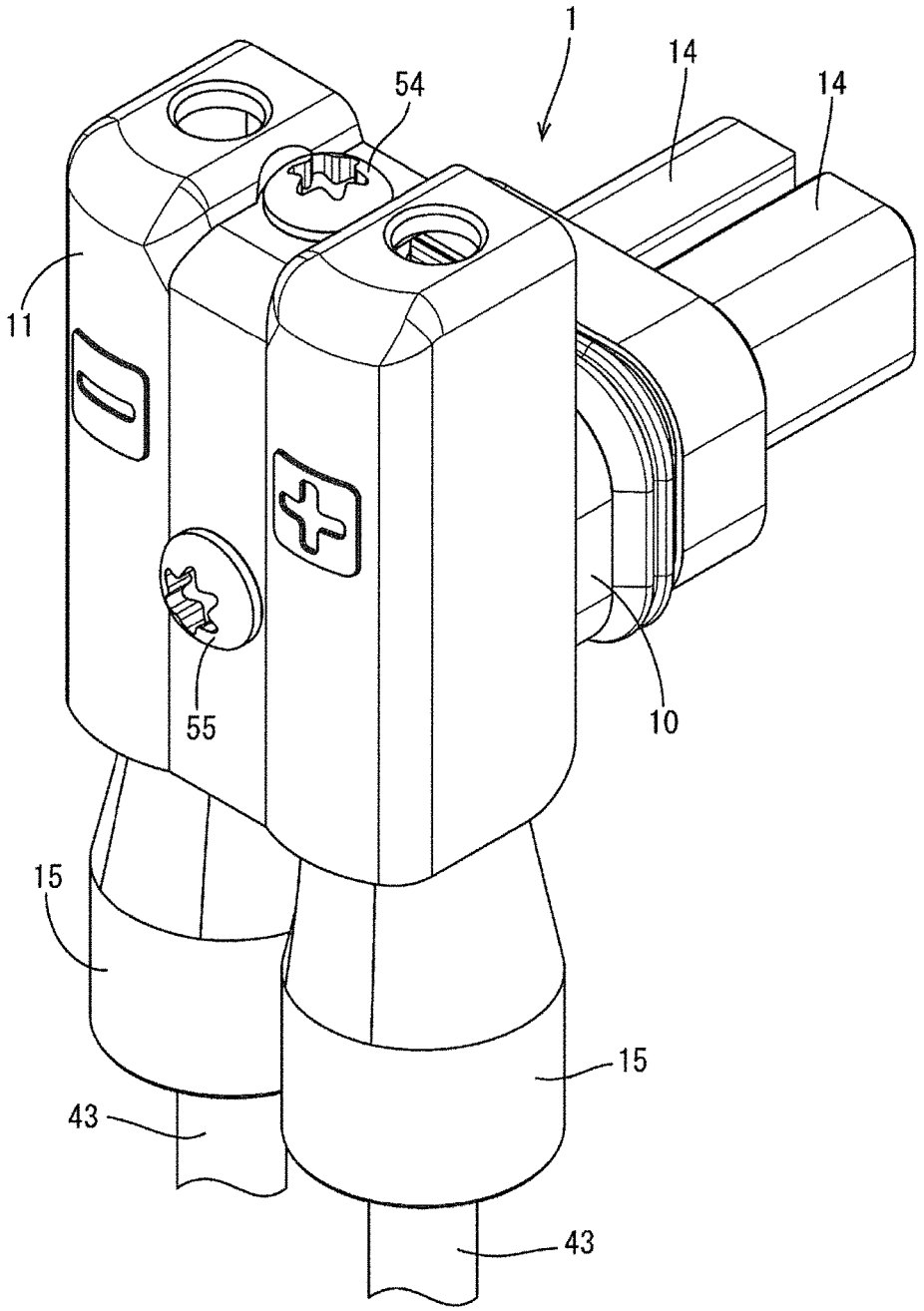
FIG. 1 is a perspective view of a connector according to an embodiment.

An embodiment is described below with reference to FIGS. 1 to 6. In the following description, a vertical direction and a front-rear direction are based on a vertical direction and a front-rear direction shown in FIG. 2, and a lateral direction is based on a lateral direction shown in FIG. 4.

A connector 1 according to this embodiment is described with reference to FIG. 1. The connector 1 is connected to a device-side connector (mating connector) disposed inside a shield case covering a device, such as an inverter or motor mounted in a vehicle, such as a hybrid vehicle or electric vehicle. The connector 1 includes a housing 10 and a shield shell 11. The housing 10 is formed of synthetic resin and the shield shell 11 is formed of a conductive metal material. Although not shown in FIG. 1, two conductive units are housed inside the housing 10. The conductive unit includes a female terminal, an inner conductive member 40 (see FIG. 2) and a wire 43. The female terminal is an example of a terminal.

(1) Housing

Figure 2:
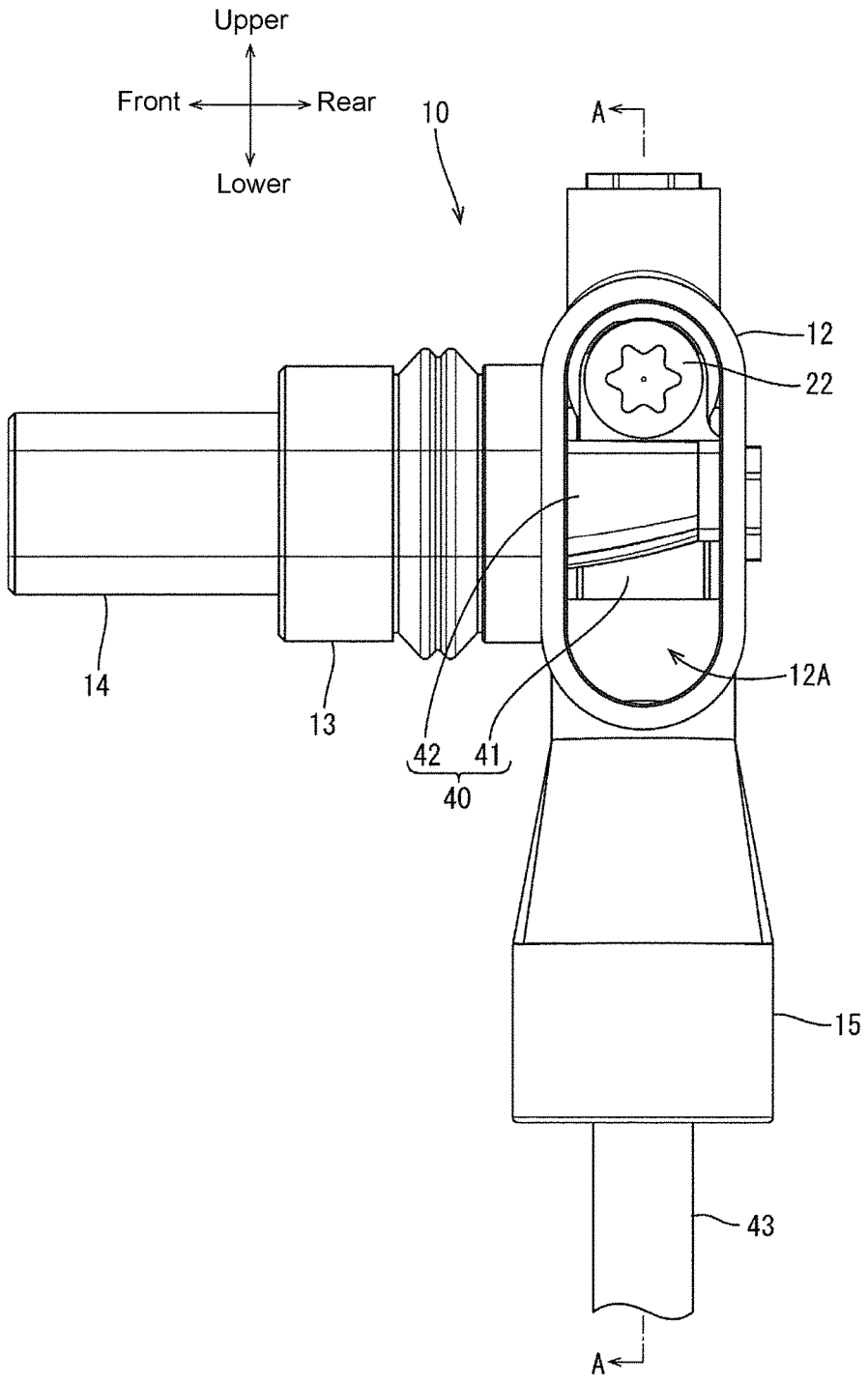
FIG. 2 is a left side view of a housing.

As shown in FIG. 2, the housing 10 is substantially L-shaped in a side view and includes a body 12, a fitting portion 13, two terminal accommodating portions 14 (see FIG. 3) and two wire pull-out portions 15 (see FIG. 1).

(1-1) Body

Figure 3:
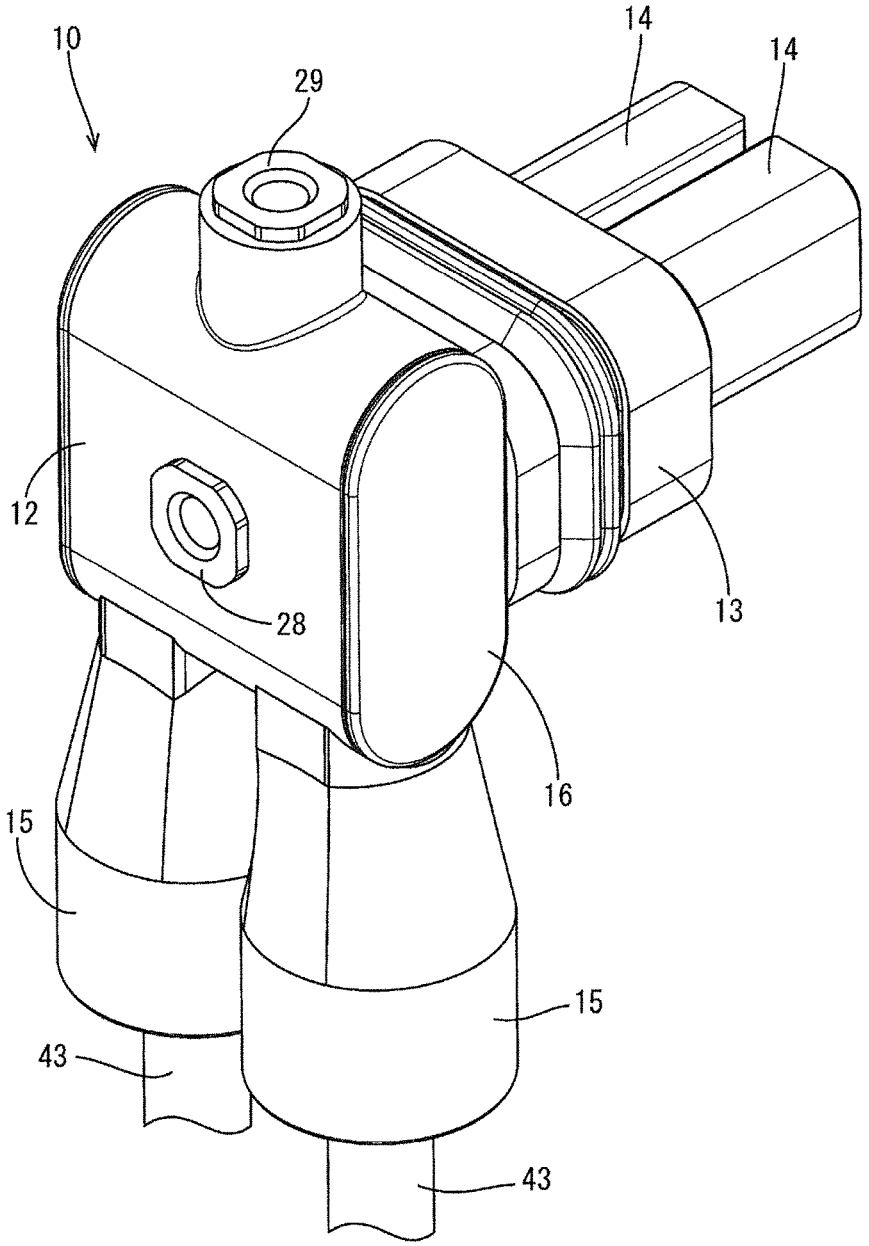
FIG. 3 is a perspective view of the housing.

The body 12 is formed into a so-called race track shape long in the vertical direction and defined by two parallel lines and two semicircles. The body is formed with openings 12A on both sides in the lateral direction (direction perpendicular to the plane of FIG. 2). The opening 12A is used by a worker to fix the inner conductive member 40 inside the housing 10. As shown in FIG. 3, the opening 12A is closed by a lid 16.

Figure 4:
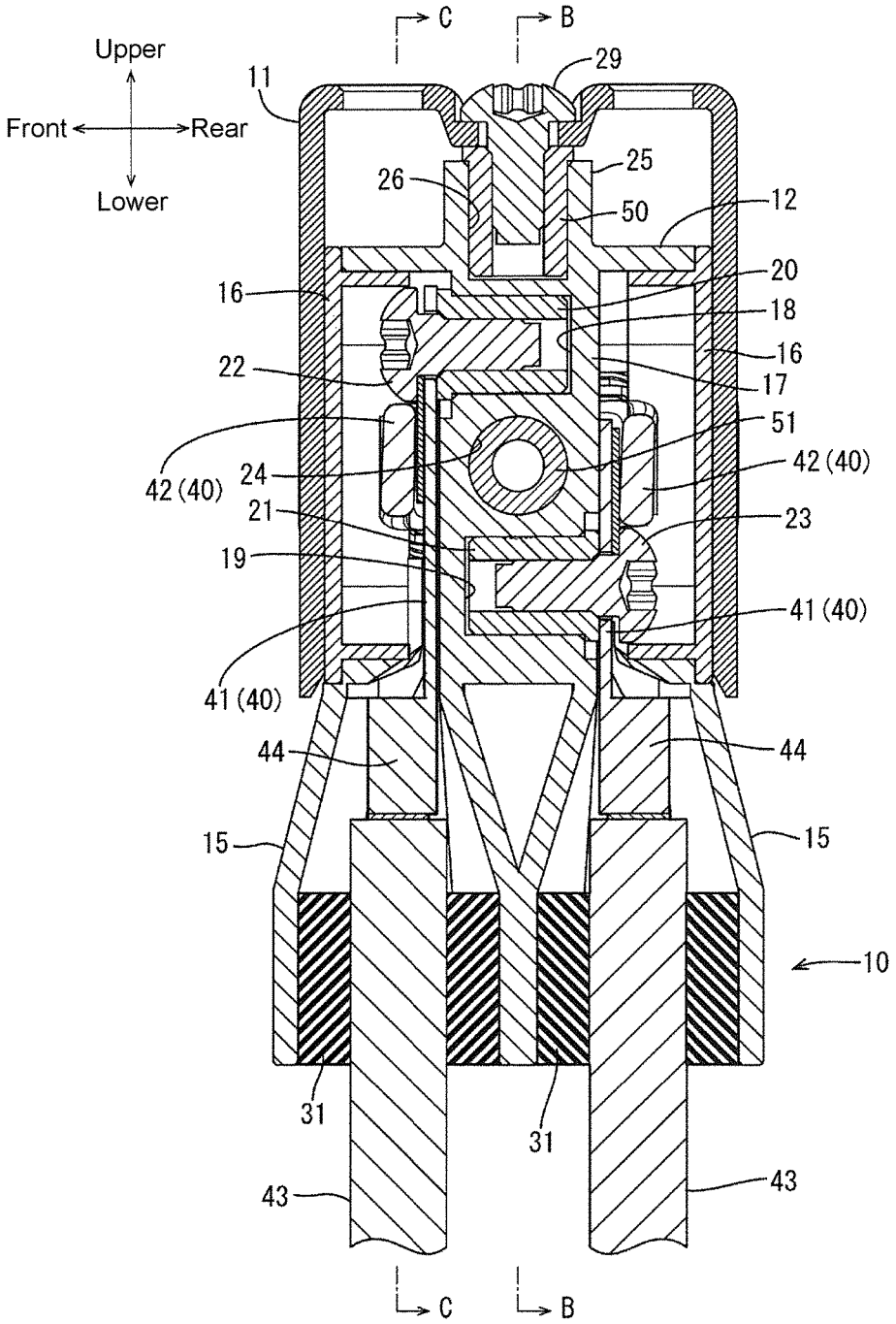
FIG. 4 is a section along A-A of FIG. 2.

As shown in FIG. 4, a fixing portion 17 is formed integrally inside the body 12 to laterally partition an internal space of the body 12. Each inner conductive member 40 (joining portion 41 and flexible conductor 42) is fixed to the fixing portion. More particularly, two inner conductive members 40 are fixed to the fixing portion 17 by a first bolt 22 and a second bolt 23 extending in the lateral direction on both sides in the lateral direction (arrangement direction of the two wires 43).

Specifically, the fixing portion 17 is formed with a bottomed hole 18 open leftward and a bottom hole 19 open rightward. Nuts 20, 21 are press-fit respectively into those holes 18, 19 and the first and second bolts 22, 23 for fixing the inner conductive members 40 are fastened respectively to the nuts 20, 21.

As shown in FIG. 4, the nuts 20, 21 are arranged side by side in an extending direction (vertical direction in FIG. 4) of the two wires 43 in the housing 10. Thus, the two nuts 20, 21 overlap in the arrangement direction of the two wires 43 (lateral direction in FIG. 4).

Figure 5:
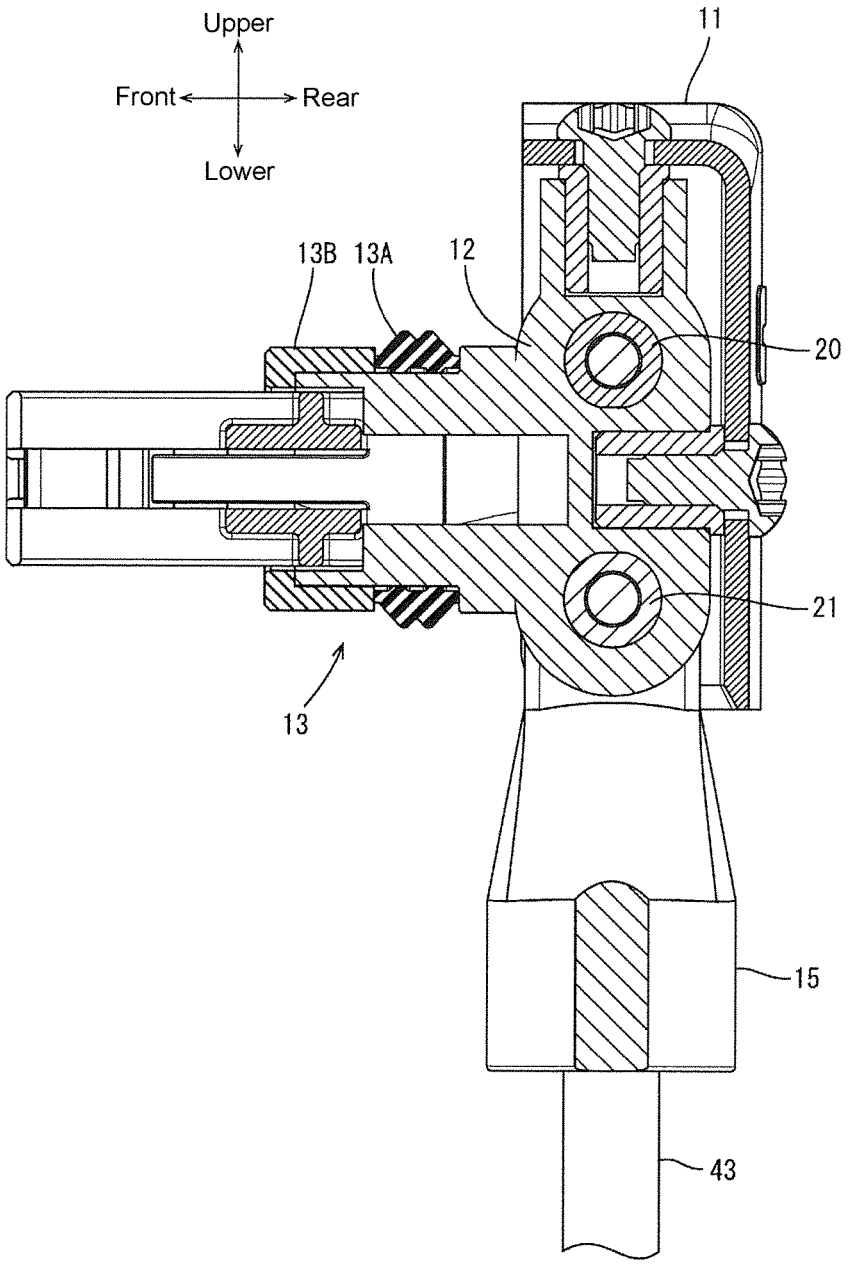
FIG. 5 is a section along B-B of FIG. 4.

Further, as shown in FIG. 5, the nuts 20, 21 are located on an extension of the wires 43 when viewed in the arrangement direction of the two wires 43 (direction perpendicular to the plane of FIG. 5). That is, the fixed position of one inner conductive member 40 and that of the other inner conductive member 40 match in the front-rear direction and are located on the extension of the wires 43. Here, the front-rear direction is a direction perpendicular to both the arrangement direction of the two wires 43 (direction perpendicular to the plane of FIG. 5) and the extending direction of those two wires 43 (vertical direction in FIG. 5).

As shown in FIG. 4, the fixing portion 17 also is formed with a bottomed hole 24 open rearward. The hole 24 is open in the rear surface of the body 12 and a nut 51 is press-fit thereinto from the outside of the body 12. Further, a cylindrical nut press-fit portion 25 extending upward is formed on the top of the body 12. The nut press-fit portion 25 is formed with a bottomed hole 26 open up and a nut 50 is press-fit into the bottomed hole 26 from the outside of the body 12. Bolts 28, 29 (see FIG. 3) for fixing the shield shell 11 to the body 12 are fastened to these nuts 50, 51.

(1-2) Fitting Portion

As shown in FIG. 3, the fitting portion 13 protrudes from a front side of the body 12 and has a rectangular tube shape. The fitting portion 13 is fit and inserted into a case-side opening formed in a device-side shield shell.

As shown in FIG. 5, a seal ring 13A made of rubber is fit on the outer periphery of the fitting portion 13. The seal ring 13A seals between the fitting portion 13 and the inner surface of the case-side opening. A retainer 13B is mounted on the fitting portion 13 from the left, thereby preventing the detachment of the seal ring 13A.

(1-3) Terminal Accommodating Portion

Figure 6:
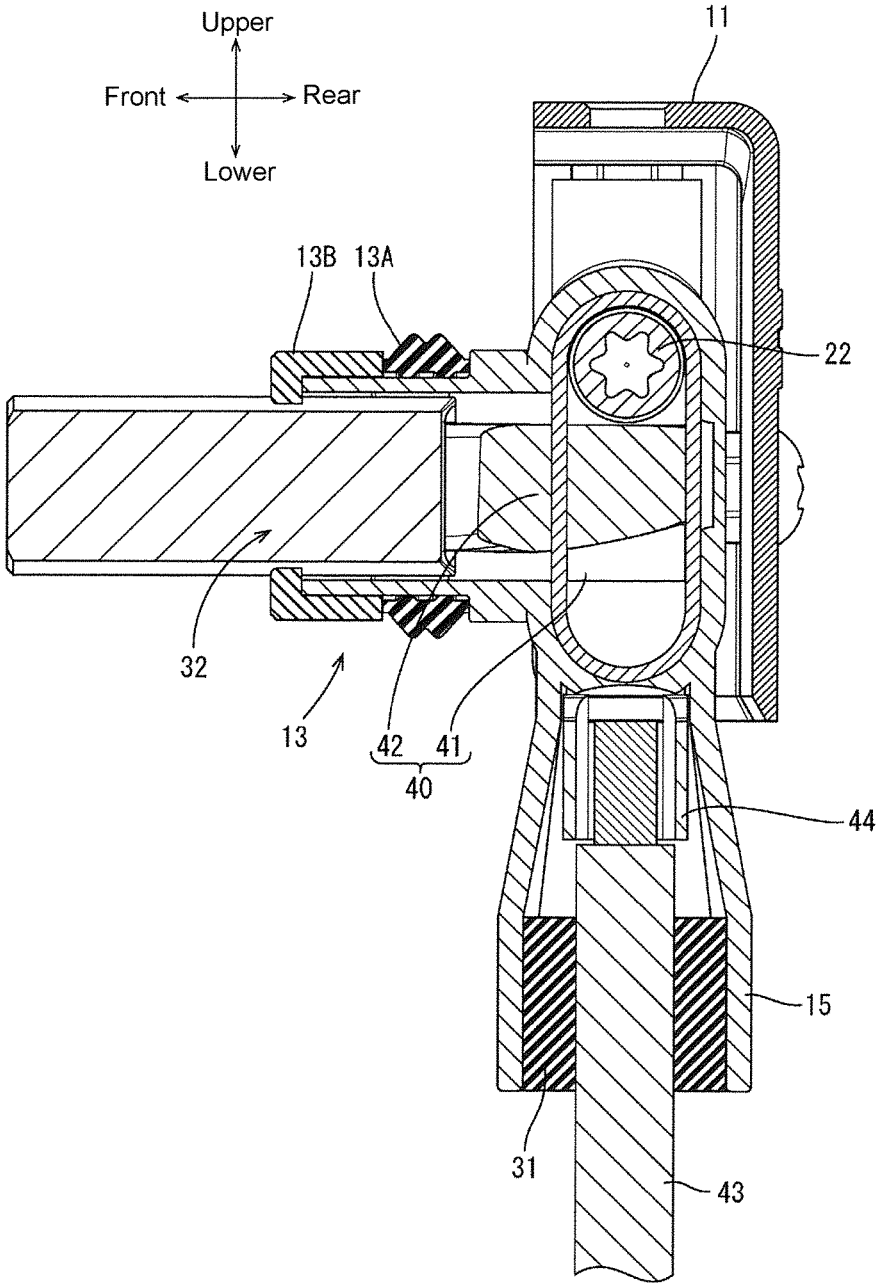
FIG. 6 is a section along C-C of FIG. 4.

As shown in FIG. 1, two terminal accommodating portions 14 project forward from a front side of the fitting portion 13. Specifically, as shown in FIG. 6, an opening 32 is formed in the left surface of the fitting portion 13 and the terminal accommodating portion 14 is fit and inserted into the fitting portion 13 through the opening 32 with a right side part in the lead, and fixed to the fitting portion 13. Each terminal accommodating portion 14 is formed into a rectangular tube shape and an unillustrated female terminal is inserted inside.

(1-4) Wire Pull-Out Portion

As shown in FIG. 4, the wire pull-out portion 15 includes a conical part conically expanding from the bottom of the body 12 and a hollow cylindrical part extending from the lower end of the conical part, and an upper end part of the wire 43 is accommodated inside. The two wires 43 are held substantially in parallel in the wire pull-out portions 15 and pulled out downwardly.

An annular rubber plug 31 is accommodated inside the hollow cylindrical part of the wire pull-out portion 15, and the wire 43 is inserted through a through hole formed in a center of the rubber plug 31. The rubber plug 31 seals between the wire 43 and the inner surface of the wire pull-out portion 15 over the entire circumference.

(2) Conductive Unit

Next, the conductive unit is described with reference to FIG. 6. As described above, the conductive unit includes the unillustrated female terminal, the inner conductive member 40 (joining portion 41 and flexible conductor 42) and the wire 43.

The female terminal contacts a mating terminal provided in a mating connector. The female terminal is formed of a conductive metal material and a right side part thereof is joined to a left edge part of the flexible conductor 42 by welding or crimping.

The inner conductive member 40 is for electrically connecting the female terminal and the wire 42 inside the housing 10. The inner conductive member 40 is composed of the joining portion 41 and the flexible conductor 42 and is substantially L-shaped.

The joining portion 41 is formed with a through hole in an upper end part in a longitudinal direction. The through hole is provided to receive the first bolt 22. Further, a wire crimping portion 44 to be crimped to the wire 43 is formed on a lower end part of the joining portion 41 in the longitudinal direction. As shown in FIG. 4, two joining portions 41 differ in vertical length and the joining portion 41 fixed to a left side of the fixing portion 17 is longer in the vertical direction than the joining portion 41 fixed to a right side.

Referring back to FIG. 6, the flexible conductor 42 is configured by overlapping braided wires each of which is formed by braiding thin metal strands made of copper or copper alloy. As described above, the female terminal is joined to the left edge part of the flexible conductor 42. On the other hand, a right edge part of the flexible conductor 42 is joined to the joining portion 41 by welding to a right edge part of the joining portion 41. In this way, the flexible conductor 42 can be made longer as compared to the case where the flexible conductor 42 is welded to the left edge part of the joining portion 41. Thus, the flexibility of the flexible conductor 42 is ensured.

Note that although the flexible conductor 42 is joined to the joining portion 41 by welding in this embodiment, the flexible conductor 42 may be joined by known connection means such as brazing and soldering. Alternatively, the flexible conductor 42 may be fastened to the fixing portion 17 together with the joining portion 41 by the first or second bolt 22, 23.

The wire 43 has a core composed of metal strands covered with an insulation coating, and the wire crimping portion 44 is crimped to the core exposed by removing the coating of an upper end part. Note that although the wire 43 is connected to the joining portion 41 by crimping in this embodiment, this connection is not limited to crimping and can be done by another known connection method such as welding.

(3) Shield Shell

As shown in FIG. 1, the shield shell 11 covers upper, left, right and rear sides of the body 12. The shield shell 11 is formed with through holes in surfaces facing upward and rearward, and bolts 54, 55 are inserted through these through holes. The shield shell 11 is fixed to the housing 10 by inserting the bolts 54, 55 into those holes and fastening the bolts 54, 55 to the nuts 50, 51 described above.

(4) Assembling of Connector

In assembling the connector 1, the wire crimping portion 44 of the joining portion 41 is crimped to the wire 43 and the female terminal is welded to the flexible conductor 42 outside the housing 10. Then, the joining portion 41 crimped to the wire 43 is inserted into the body 12 from the side of the wire pull-out portion 15 and fixed to the fixing portion 17 by the first or second bolt 22, 23.

After the joining portions 41 are fixed to the fixing portion 17, the terminal accommodating portions 14 are fit and inserted into the fitting portion 13 from the left, as shown in FIG. 6. When the terminal accommodating portions 14 are fit and inserted, the flexible conductors 42 overlap the joining portions 41 and, in that state, the flexible conductors 42 are welded to the joining portions 41.

The openings 12A are closed with the lids 16, and the shield shell 11 then is fixed to the housing 10.

(5) Effects of Embodiment

According to the connector 1 described above, the fixing portion 17 is arranged between the two inner conductive members 40. Thus, the connector 1 can be reduced in size in the above-described perpendicular direction, as compared to the case where the fixing portion 17 is arranged on one side in the direction (front-rear direction in FIG. 2) perpendicular to both the arrangement direction of the two wires 43 (direction perpendicular to the plane of FIG. 2) and the extending direction of those two wires 43 (vertical direction in FIG. 2) with respect to the inner conductive members 40 as before. Specifically, the connector 1 can be reduced in size in the above-described perpendicular direction by arranging the fixing portion 17 in the insulation space secured to insulate the two inner conductive members 40.

Further, according to the connector 1, the fixed positions of the two inner conductive members 40 are located on the extension of the wires 43 when viewed in the arrangement direction of the two wires 43, as shown in FIG. 5. Thus, the connector 1 can be reduced in size in the perpendicular direction as compared to the case where the fixed position of one inner conductive member 40 and that of the other inner conductive member 40 are shifted in the perpendicular direction or the positions of the wires 43 are shifted in the perpendicular direction with respect to the fixed positions of the two inner conductive members 40.

The two nuts 20, 21 to which the bolts 22, 23 for fixing the inner conductive members 40 are to be fastened are arranged side by side in the extending direction of the wires 43 (vertical direction in FIG. 4) in the housing 10. Thus, the two nuts 20, 21 overlap in the arrangement direction of the two wires 43 (lateral direction in FIG. 4). In this way, a width of the fixing portion 17 in the arrangement direction can be narrowed as compared to the case where the two nuts 20, 20 do not overlap at all in the arrangement direction.

If the inner conductive member 40 is provided with a through hole through which a bolt is to be inserted in the direction (e.g. direction perpendicular to the plane of FIG. 4) perpendicular to the arrangement direction of the two wires 43, as before, a width of the inner conductive member 40 in the arrangement direction cannot be made smaller than a diameter of the through hole. However, the inner conductive member 40 of the connector 1 need not include a through hole through which a bolt is to be inserted in the perpendicular direction. Thus, the width of the inner conductive member 40 in the arrangement direction can be made narrower than before.

According to the connector 1, both the fixing portion 17 and the inner conductive members 40 can be narrowed in the arrangement direction of the two wires 43 so that the housing 10 can be reduced in size in the arrangement direction.

The invention is not limited to the above described and illustrated embodiment. For example, the following embodiments are also included in the technical scope disclosed by this specification.

A case where the fixed positions of the two joining portions 41 are located on the extension of the wires 43 when viewed in the arrangement direction of the two wires 43 has been illustrated in the above embodiment. In contrast, the fixed position of one joining portion 41 may be shifted from that of the other joining portion 41 in the front-rear direction shown in FIG. 5 or the positions of the wires 43 may be shifted in the front-rear direction with respect to the fixed positions of the two joining portions 41 within such a range that the size is reduced in the front-rear direction more than before.

A case where the first and second bolts 22, 23 partially overlap in the arrangement direction of the two wires 43 has been illustrated in the above embodiment. However, these bolts may not overlap at all in the arrangement direction if the enlargement in the arrangement direction is not problematic.

A case where the inner conductive member 40 is divided into the joining portion 41 and the flexible conductor 42 has been illustrated in the above embodiment. However, the inner conductive member 40 may not necessarily be divided into the joining portion 41 and the flexible conductor 42. For example, the female terminal may be directly welded to the joining portion 41.

Although a case where the flexible conductor 42 is composed of braided wires has been illustrated in the above embodiment, the flexible conductor 42 may be a flexible wire.

A case where the housing 10 is substantially L-shaped has been illustrated in the above embodiment. In contrast, the housing 10 may have a straight shape.

The connector 1 described in the above embodiment can also be rephrased as follows.

The connector 1 includes the housing 10 to be connected to the mating connector and two conductive units, each conductive unit includes the unillustrated female terminal configured to contact the mating terminal provided in the mating connector, the wire 43 and the inner conductive member 40 for electrically connecting the female terminal and the wire 43, the fixing portion 17 to which the inner conductive members 40 are to be fixed and in which the two nuts 20, 21 are arranged in parallel in such a posture that axes extend in the direction (lateral direction in FIG. 4) perpendicular to a connecting direction of the housing 10 (direction perpendicular to the plane of FIG. 4) is provided inside the housing 10, the bolt 22 for fixing one inner conductive member 40 is fastened to one nut 20 from one side (left side in FIG. 4) in the perpendicular direction (lateral direction in FIG. 4) and the bolt 23 for fixing the other inner conductive member 40 is fastened to the other nut 21 from the other side (right side in FIG. 4) in the perpendicular direction (lateral direction in FIG. 4).

According to the connector 1 thus configured, since the two nuts 20, 21 are arranged in parallel in such a posture that the axes extend in the direction (lateral direction in FIG. 4) perpendicular to the connecting direction of the housing 10, i.e. the two nuts 20, 21 overlap in the perpendicular direction, the connector 1 can be reduced in size in the perpendicular direction.

Note that although a case where the two nuts 20 21 are arranged side by side in the extending direction of the wires 43 has been illustrated in the above embodiment, the arrangement direction of the nuts 20, 21 is not limited to the extending direction of the wires 43. For example, the two nuts 20, 21 may be arranged side by side in the connecting direction of the housing (direction perpendicular to the plane of FIG. 4). In such a case, the connector 1 cannot be necessarily reduced in size in the connecting direction, i.e. front-rear direction, but the size can be reduced in the direction (lateral direction in FIG. 4) perpendicular to the connecting direction.

LIST OF REFERENCE SIGNS

1 . . . connector
10 . . . housing
17 . . . fixing portion
20 . . . nut
21 . . . nut
22 . . . bolt
23 . . . bolt
40 . . . inner conductive member (conductive unit)
43 . . . wire (conductive unit)

The invention claimed is:

1. A connector in which two wires are held substantially in parallel in a housing and pulled to the outside, comprising:

the housing to be connected to a mating connector; and two conductive units;

wherein:

each conductive unit includes a terminal configured to contact a mating terminal provided in the mating connector, the wire, and an inner conductive member for electrically connecting the terminal and the wire;

a fixing portion to which the inner conductive members are to be fixed is provided inside the housing, one of the inner conductive members is fixed on one side in an arrangement direction of the two wires in the housing and the other inner conductive member is fixed on the other side; and each of the inner conductive members is fixed to the fixing portion by a bolt extending in the arrangement direction.

2. The connector of claim 1, wherein fixed positions of the two inner conductive members are located on an extension of the wires when viewed in the arrangement direction.

3. The connector of claim 2, wherein a nut to which a bolt for fixing the one inner conductive member to the fixing portion is to be fastened and a nut to which a bolt for fixing the other inner conductive member to the fixing portion is to be fastened are arranged side by side in the fixing portion in an extending direction of the wires in the housing.

4. A connector, comprising:

a housing to be connected to a mating connector; and two conductive units;

wherein:

each conductive unit includes a terminal configured to contact a mating terminal provided in the mating connector, a wire, and an inner conductive member for electrically connecting the terminal and the wire;

a fixing portion to which the inner conductive members are to be fixed and in which two nuts are arranged in parallel in such a posture that axes extend in a direction perpendicular to a connecting direction of the housing is provided inside the housing; and a bolt for fixing one of the inner conductive members is fastened to one of the nuts from one side in the perpendicular direction and a bolt for fixing the other inner conductive member is fastened to the other nut from the other side in the perpendicular direction.

* * * * *